US005096451A

United States Patent [19]

Smith et al.

[11] Patent Number: 5,096,451

[45] Date of Patent: Mar. 17, 1992

[54] TOY MERMAID WITH VOICE UNIT

[75] Inventors: Robin K. Smith, Long Beach; Liliane Davidson, Studio City; William Hart, Palos Verdes Est., all of Calif.

[73] Assignee: Mattel, Inc., El Segundo, Calif.

[21] Appl. No.: 652,520

[22] Filed: Feb. 8, 1991

[51] Int. Cl.[5] ..... A63H 33/00; A63H 23/00; A63H 3/28; A63H 29/22

[52] U.S. Cl. ..... 446/14; 446/153; 446/159; 446/302; 446/484; D21/157

[58] Field of Search ..... D21/157; 446/14, 153, 446/156, 157, 158, 159, 227, 268, 297, 298, 299, 302, 397, 484, 485

[56] References Cited

U.S. PATENT DOCUMENTS

| | | | |
|---|---|---|---|
| D. 65,838 | 10/1924 | Stevens | D21/157 |
| D. 197,138 | 12/1963 | Ogg | D21/157 X |
| D. 239,040 | 3/1976 | Evans | D21/157 X |
| 3,755,960 | 9/1973 | Tepper et al. | 446/299 |
| 3,888,233 | 6/1975 | Ware | 446/295 X |
| 4,314,423 | 2/1982 | Lipsitz et al. | 446/14 A |
| 4,451,911 | 5/1984 | Klose et al. | 446/303 X |
| 4,702,140 | 10/1987 | Goldfarb | 446/303 X |
| 4,713,037 | 12/1987 | Tong | 446/156 X |
| 4,964,837 | 10/1990 | Collier | 446/409 |

FOREIGN PATENT DOCUMENTS

| | | | |
|---|---|---|---|
| 8304184 | 12/1983 | PCT Int'l Appl. | 446/297 |
| 8810139 | 12/1988 | PCT Int'l Appl. | 446/14 |

OTHER PUBLICATIONS

"Color Racers," Mattel Hot Wheels, 12/88.
"Hello Color," Sanrio, Playthings, 2/85.
"Sweet Sea," Tomy, Earnshaw's, 2/85.

*Primary Examiner*—David N. Muir

[57] ABSTRACT

A doll including a body, the body being shaped to depict the body of a mermaid, a head, the body and head having generally hollow interiors, apparatus positioned within the body and the head for providing sound, and apparatus for activating the apparatus for providing sound.

7 Claims, 4 Drawing Sheets

TOY MERMAID WITH VOICE UNIT

BACKGROUND OF THE INVENTION

1. Field Of The Invention

This invention relates to toys and, more particularly, to a doll which depicts a mermaid.

2. History of The Prior Art

It is difficult for toy designers to design toys which will appeal to children. Various methods are used to make toys more attractive. One method used by designers to make a toy desirable is to design the toy so that it appears to represent a known desirable creature. Thus, for example, toys are designed to look like animals. Another method is to design a toy which represents a young being which, in general, tends to have more appealing features than do adults. Another method used by designers is to impart play value to a toy. That is, rather than simply sitting posed as a cute young animal, a toy does one or more things that the animal (or whatever it represents) does.

One creature which has long stimulated interest in young and old alike is the mythical mermaid. The mermaid has been depicted in many forms in literature and motion pictures. All of the forms described portray a beautiful half-human female floating in some attractive lagoon often singing her siren songs to passing sailors. Creating a toy which looks like a mermaid is not difficult with modern technology. Creating a toy mermaid which acts like a mermaid is much more difficult.

SUMMARY OF THE INVENTION

It is, therefore, an object of the present invention to provide a toy which depicts a mermaid and which a child may play with in water.

It is another object of the present invention to provide a toy which depicts a mermaid and is capable of singing.

It is another more specific object of the present invention to provide a toy which depicts a mermaid which a child may play with in water and which is capable of singing while in the water.

These and other objects of the present invention are realized in a doll comprising a body, the body being shaped to depict the body of a mermaid, a head, the body and head having generally hollow interiors, means positioned within the body and the head for providing sound, and means for activating the means for providing sound.

These and other objects and features of the invention will be better understood by reference to the detailed description which follows taken together with the drawings in which like elements are referred to by like designations throughout the several views.

DETAILED DESCRIPTION OF THE INVENTION

Figure 1:
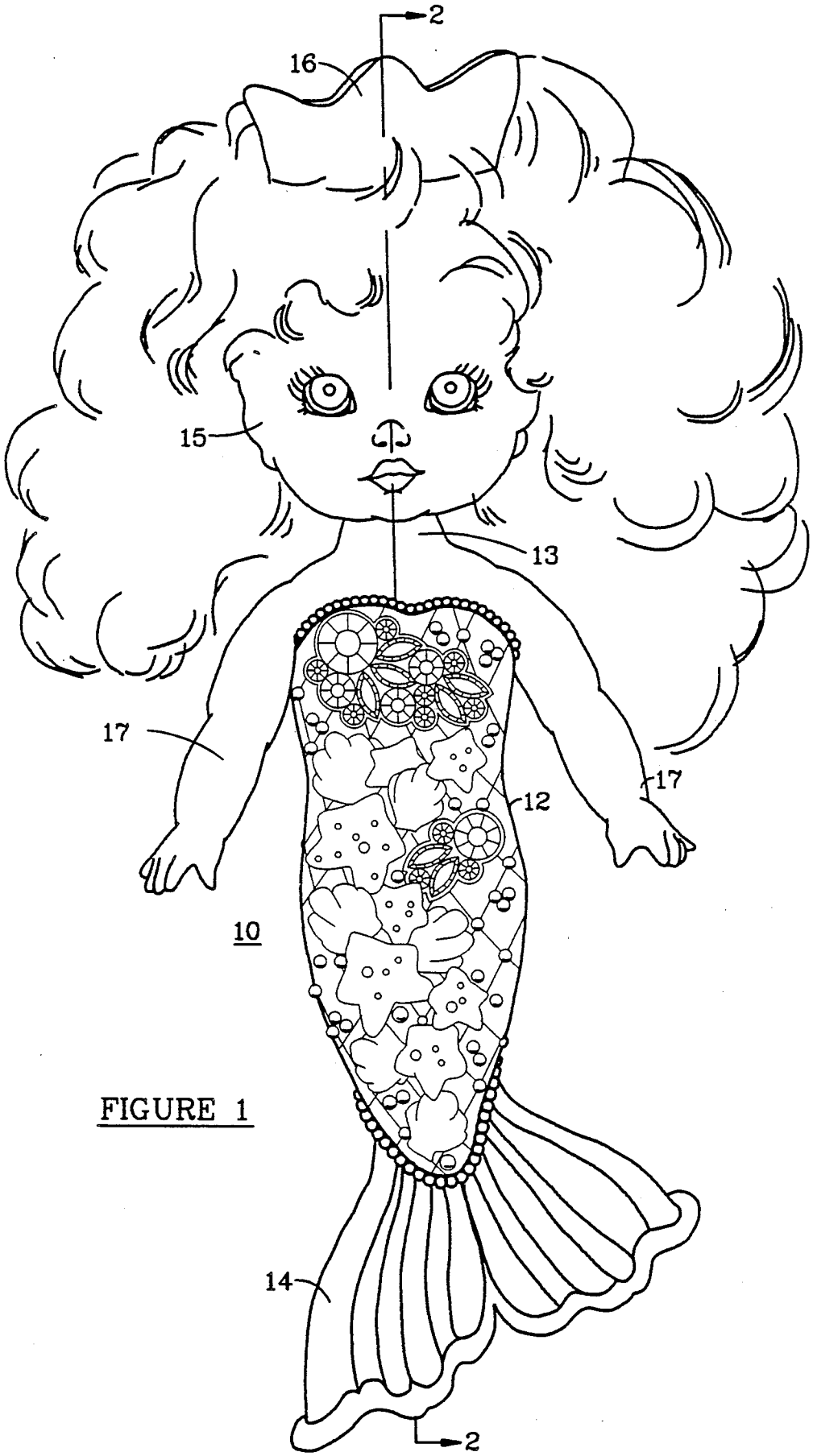
FIG. 1 is a front view of a doll constructed in accordance with teachings of the present invention.

Referring now to FIG. 1 there is illustrated a front view of a mermaid doll 10 constructed in accordance with the invention. The doll 10 includes a body portion 12. proceeding from a neck 13-down through a tail 14. Joined to the body portion 12 at the upper end is a head 15 which wears a crown 16. Also joined to the body portion 12 are a pair of arms 17.

In the preferred embodiment, the body portion 12, the head 15, and the arms 17 are all manufactured of a plastisol compound well known to those skilled in the art of doll construction. Such a compound is especially useful in producing dolls having body portions adapted to resemble body portions in that they may be made to be somewhat pliable while retaining a great deal of detail. For example, the body portion 12 is produced by rotocasting and has molded into its lower body portions the details of scales and tail which are imagined to cover the lower portion of the body of a mermaid. As may be seen in FIG. 1, the lower body is covered with realistically shaped star fish designs, with clam shell designs, and with various jewels including pearls. The fins of the tail are clearly delineated. In a preferred embodiment of the invention, certain of these details (darkened in FIG. 1) are coated with color-changing paint so that portions thereof change color when the doll enters the water. In one embodiment in which a so-called "non-memory" paint called "Metamo" is used, a color change occurs when the doll is immersed in warm water above approximately 86 degrees F. The doll remains in this color condition until the doll is immersed in cool water (below 56 degrees F.) or subjected to a cool temperature at which time the colors change back to the originals. Such color-changing paint is well known to those skilled in the toy art.

Figure 2:
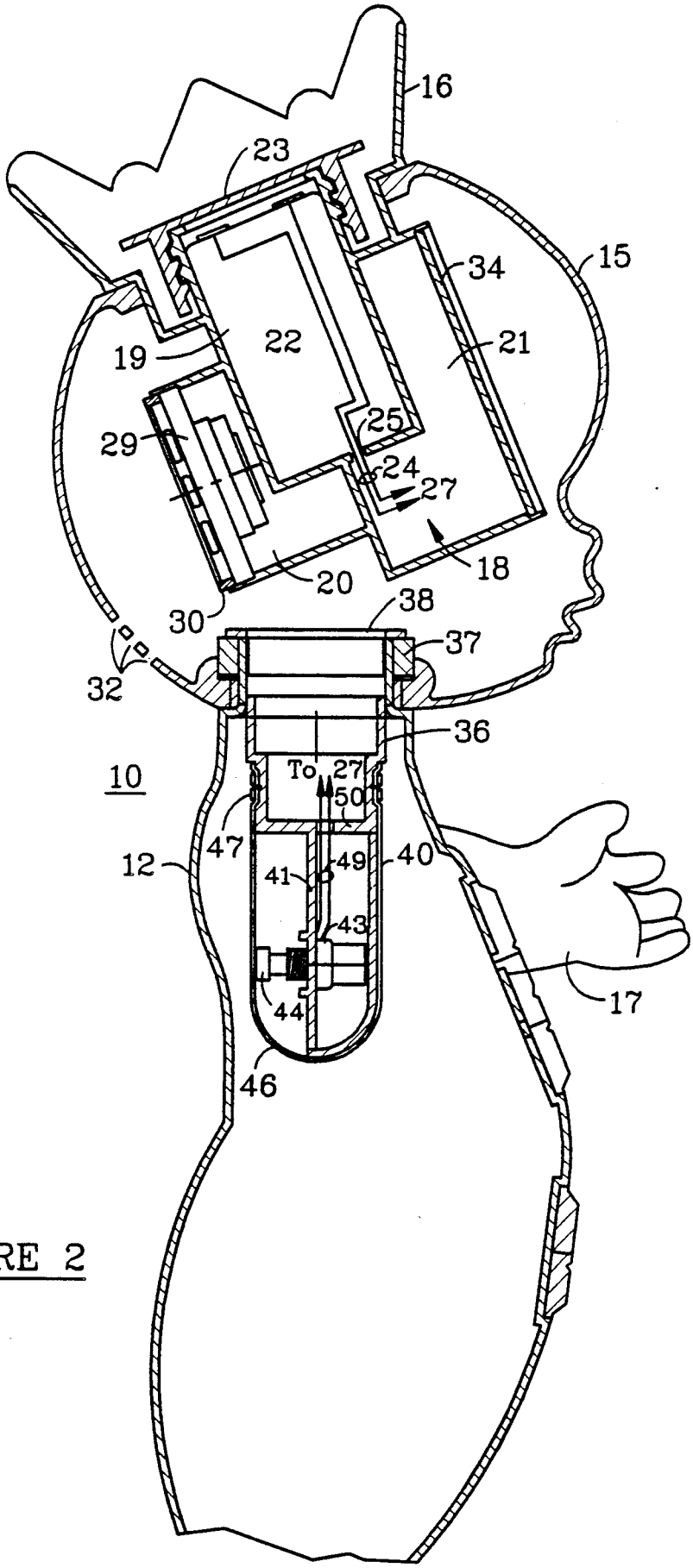
FIG. 2 is a cross-sectional side view of the doll illustrated in FIG. 1.
Figure 4:
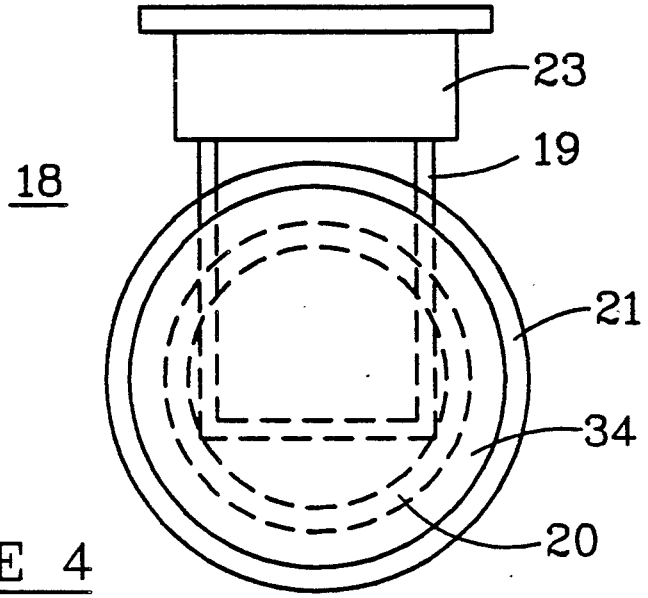
FIG. 4 is a front view of a portion of the interior of the doll illustrated in FIG. 1.
Figure 3:
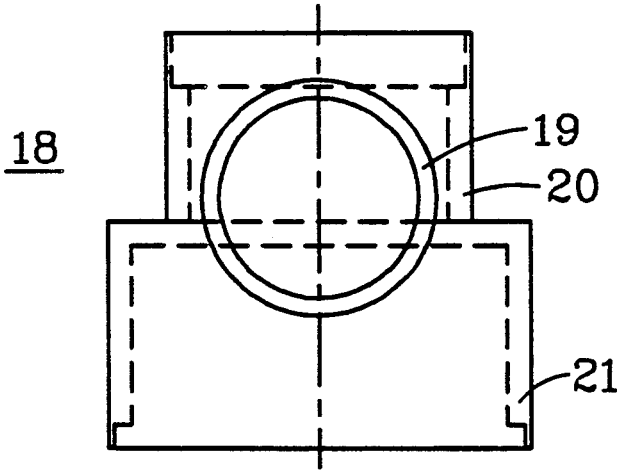
FIG. 3 is a top view of a portion of the interior of the doll illustrated in FIG. 1.
Figure 5:
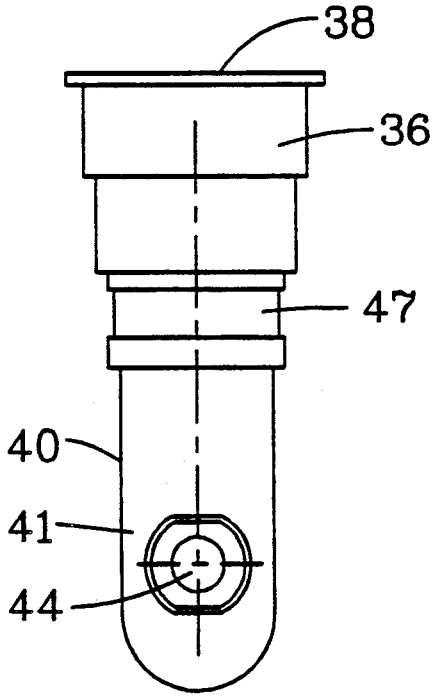
FIG. 5 is a front view of an interior detail of the doll illustrated in FIG. 1.

FIG. 2 is a cross-sectional view of the doll 10 taken along the lines 2—2 of FIG. 1. FIG. 2 is used to illustrate the shape of the doll 10 from the side and the interior of the body portion 12 and the head 15. As may be seen in cross-section, within the head 15 of the doll 10 is a housing 18 in which three cylindrical enclosures form a battery compartment 19, a speaker compartment 20, and an electronics compartment 21. FIG. 3 is a top view of the housing 18 looking into the top of the doll 10 along the axis of the cylindrical compartment 19. FIG. 4 is a side view of the housing 18 looking into the housing 18 along the axis of the cylindrical compartment 21. The three compartments 19–21 are molded together of plastic in a preferred embodiment and are generally sealed from each other to keep moisture from passing therebetween. The battery compartment 19 is formed of a size adapted to house a nine volt transistor battery 22. A screw-on cap 23 of plastic provides a watertight seal to protect the battery 22 in the compartment 19 from moisture. As may be seen in FIG. 2, the cap 23 fits down within the crown 16 and in not normally visible except from directly above.

The battery 22 in the compartment 19 is joined to a pair of conductors 24 extending through an opening 25 into the electronics compartment 21. After the conductors 24 have been placed through the opening 25, a sealant is used to eliminate leakage between the compartments 19 and 21. The conductors 24 supply the power for operating a circuit 27 within the compartment 21. The circuit 27 is a digital circuit which stores a short message and provides that message through a digital-to-analog converter to a speaker 29 housed in the speaker compartment 20. Digital recording circuits are well known to the prior art and are included for example in a toy manufactured and sold by Mattel, Inc., named "Minnie N, Me". In the preferred embodiment of the doll 10, the message recorded is a short song which plays for approximately six seconds. In order to make the doll more realistic and add play value to its use, such a song is chosen to emulate a song which a mermaid might be expected to sing.

An especially important aspect of the play value of the doll 10 is its ability to sing while immersed in the water. In order to accomplish this, it is necessary to protect the various portions of the doll 10 which accomplish the singing from moisture when the doll is swimming. To this end, the speaker 29 mounted in the cylindrical speaker compartment 20 is sealed around an edge 30 to the speaker compartment 20 by a material such as an epoxy or other sealant. This protects the rear of the speaker 29 from moisture. However, it is necessary to hear the sound coming from the speaker 29 so there must be an open path for sound to travel from the front of the speaker 29 to the listener. For this purpose, a series of holes 32 are placed through the plastisol material forming the head 15 below the hairline of the doll 10. These holes 32 allow the sound to emanate from within the head 15, but they also allow water to seep into the interior of the head 15 if the doll 10 is immersed in water. In order to eliminate damage, the speaker 29 in the preferred embodiment of the invention is selected to have a speaker cone constructed of a material which is impervious to water such as Mylar. Alternatively, a Mylar cover may be placed over and sealed to the compartment 20 and the speaker 29 at the edge 30 to protect the front external surface of the speaker 29 from moisture.

In another embodiment of the doll 10 (not shown in the drawings), the speaker compartment is positioned so that the speaker cone is adjacent the upper portion of the head 15 and holes from which the sound emanates are placed through the head inside the area of the crown 16. This involves a change in the arrangement of the compartments within the head but does not vary the manner in which the invention operates.

In addition to the protection offered for the speaker 29, the electronics compartment 21 is covered by a circular lid 34 which is sealed to the compartment 21 by waterproof sealant once the electronic circuitry is in place within the compartment 21. Since each of the compartments which make up the housing 18 residing in the interior of the head 153 is watertight, water entering the holes 32 which allow sound to exit from the head 15 do not cause damage to any of the elements of the arrangement for providing sound. Moreover, as may be seen in the cross-section of FIG. 2, to the exterior of the doll 10, there is nothing to indicate that the doll is equipped with any of the accoutrement which is necessary to produce sound. The holes 32 through which the sound is emitted are well hidden under the hair line of the doll. The cap 23 which covers the battery 22 may be painted or otherwise colored and shaped to appear as a part of the interior of the crown 16.

In a similar manner, the means for actuating the sound system is hidden from the view of even a critical observer. The actuating arrangement for the sound system is hidden within the body of the doll 10 in a molded housing 36. The housing 36 is generally cylindrical in shape at an upper end and is shaped to fit tightly to the inside of a neck plug 37 which extends upwardly from the body 12 and positions the head 15. A circular ridge 38 protrudes outwardly at a right angle to the axis of the upper cylindrical portion of the housing 36 and keeps the housing from sliding downward. The lower portion 40 of the housing 36 is molded into essentially a half cylinder closed by a downwardly depending wall 41. The wall 41 supports a switch 43 which is of a conventional normally-open type and has a push button actuator 44 for closing the electrical contacts The entire lower portion of the housing 36 is covered by a flexible shroud 46 which fits over the lower end of the cylindrical portion of the housing 36 and is held in place as by a band clamp 47. A pair of wires 49 (which complete the circuit between the battery and the electronics) extend from the switch 43 through the housing 36 and into the electronic compartment 21. Where the wires pass through an interior horizontal wall 50 of the housing 36, the housing is sealed to protect the switch 43 against moisture. Actuation of the switch 43 causes the electronic circuitry in the compartment to play the selected song or other recorded message through the speaker 29.

The housing 36 mounts the button 44 which actuates the switch 43 closely adjacent the back of the doll 10. Since the shroud 46 is formed of a flexible material such as a soft plastic or rubber and the body of the doll 10 is formed of a material which also flexes, a simple push to the back of the doll 10 in the area of the button 44 will depress the button 44 and close the electrical circuit thereby actuating the voice unit. Thus, the switch which might be expected to protrude from the doll is cleverly hidden from view while being protected from moisture within the sealed enclosure within the body 12 of the doll 10.

As may be seen, the body 12 and head 15 each has a hollow interior cavity. In these cavities are positioned the various electronic components of the doll which enable it to sing in response to the action of the child. Consequently, the child may play with the doll in the water so that the body of the doll goes through the various color changes referred to above. The child may actuate the sound mechanism while playing with the doll in the water by depressing the back of the doll 10 to close the switch 43, and the doll will appear to sing while swimming. All of these features add significantly to the play value of the doll.

Although the present invention has been described in terms of a preferred embodiment, it will be appreciated that various modifications and alterations might be made by those skilled in the art without departing from the spirit and scope of the invention. The invention should therefore be measured in terms of the claims which follow.

What is claimed is:

1. A doll comprising a body, the body being shaped to depict the body of a mermaid, a head, the body and head having generally hollow interiors, means positioned within the body and the head for providing sound including a speaker which is sealed to moisture, and in which the body and head are sealed to the passage of moisture except adjacent the speaker, means for activating the means for providing sound, and in which holes for carrying sound are placed in an exterior surface of the doll.

2. A doll as claimed in claim 1 which further comprises hair on the head, and in which the holes for carrying sound are placed through the head of the doll in a position covered by the hair and adjacent to the speaker.

3. A doll as claimed in claim 1 in which the means for activating the means for providing sound is a switch positioned with the doll adjacent a flexible exterior surface of the doll which switch is adapted to be activated by pressing the flexible surface of the doll.

4. A doll as claimed in claim 3 in which the exterior of the body is coated with a material which changes color int he presence of moisture at a particular temperature.

5. A doll as claimed in claim 1 in which at least some portion of the exterior of the body is coated with a material which changes color in the presence of moisture at a particular temperature and in response to a particular temperature.

6. A doll as claimed in claim 1 in which the means for providing sound further comprises a battery, and an electronic circuit for replaying stored sound.

7. A doll as claimed in claim 1 in which each element of the means for providing sound is sealed to keep out moisture.

* * * * *